United States Patent [19]

Watts et al.

[11] 4,088,565

[45] May 9, 1978

[54] SOLVENT DEWAXING PROCESS

[75] Inventors: Leonard R. Watts, Nederland, Tex.; Norman L. Brewer, Rockaway Township, Morris County, N.J.

[73] Assignee: Texaco Inc., New York, N.Y.

[21] Appl. No.: 812,958

[22] Filed: Jul. 5, 1977

[51] Int. Cl.[2] ..... C10G 43/08

[52] U.S. Cl. ..... 208/33; 208/37

[58] Field of Search ..... 208/33

[56] References Cited

U.S. PATENT DOCUMENTS

| | | | |
|---|---|---|---|
| 2,698,279 | 12/1954 | Mondria | 208/33 |
| 3,871,991 | 3/1975 | Shaw | 208/33 |

*Primary Examiner*—Herbert Levine

*Attorney, Agent, or Firm*—Thomas H. Whaley; Carl G. Ries; Douglas H. May, Jr.

[57] ABSTRACT

A process for dewaxing waxy petroleum distillate oil stock wherein one volume waxy oil stock is mixed with about 0.5–2 volumes aromatic hydrocarbon dewaxing solvent, and the oil/aromatic solvent mixture heated to a temperature for dissolving all solid wax therein, wherein the oil/aromatic solvent mixture is cooled at a rate of about 1°–8°F/min. to a selected separation temperature for precipitating wax crystals and forming a wax/oil/aromatic solvent mixture, wherein the wax-/oil/aromatic solvent mixture is mixed with 0.5–2 volumes of ketone dewaxing solvent at said separation temperature for a residence time of about 15 seconds to two minutes for precipitating additional wax, and wherein solid wax and dewaxed oil are recovered as products of the process.

5 Claims, 1 Drawing Figure

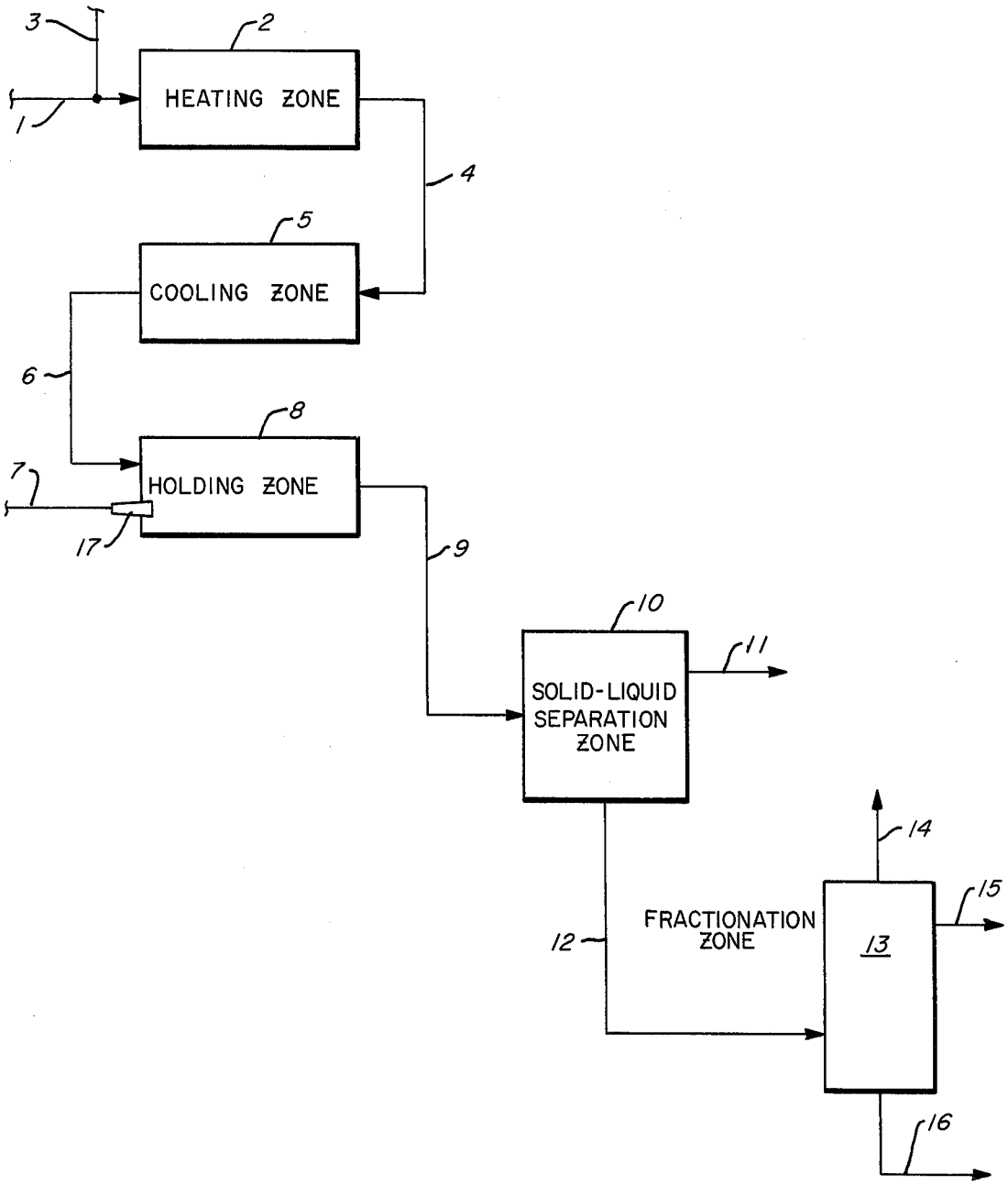
3
2
HEATING ZONE
1
4
5
COOLING ZONE
6
8
7
HOLDING ZONE
17
9
10
11
SOLID-LIQUID SEPARATION ZONE
14
15
FRACTIONATION ZONE
12
13
16

SOLVENT DEWAXING PROCESS

BACKGROUND OF THE INVENTION

The present invention relates to a solvent dewaxing process for dewaxing waxy distillate petroleum oil stocks. More particularly, the invention relates to a solvent dewaxing process wherein waxy distillate petroleum oil stock is mixed with an aromatic solvent to form a mixture in which all wax is dissolved, wherein this mixture is cooled to a selected separation temperature, and wherein the cooled mixture is mixed with ketone solvent for precipitation of additional wax.

DESCRIPTION OF THE PRIOR ART

It is known in the prior art to dewax wax petroleum oil stocks by cooling oil-solvent solutions at uniformly slow rates, of e.g. 1°-8° F. minute (0.56°-4.4° C/min), under controlled conditions of crystallization of wax from said solutions. Commercially, such oil-solvent solutions are cooled by several methods such as indirect heat exchange in scraped surface exchangers, dilution chilling wherein waxy oil stock is contacted in a multistage tower with chilled solvent under conditions of high levels of agitation U.S. Pat. No. 3,773,650); and direct chilling, wherein a low boiling solvent, e.g. propylene, mixed with waxy oil stock is vaporized under conditions of reduced pressure.

In such commercial processes, the waxy oil charge, or solution of waxy oil charge and solvent, are heated to a temperature at which all the wax present is dissolved. The heated charge is then passed into a cooling zone wherein cooling is undertaken at a uniform slow rate in the range of about 1°-8° F/minute (0.56°-4.4° C/min.) until a temperature is reached at which a substantial portion of the wax is crystalized and at which dewaxed oil product has a selected pour point temperature. Upon achieving the desired dewaxing temperature, the mixture of wax crystals, oil and solvent is subjected to solid-liquid separation for recovery of a wax free oil-solvent solution and a solid wax containing a minor proportion of oil (slack-wax). The separated oil-solvent solution is subjected to fractional distillation for recovery of a solvent fraction, and a product dewaxed oil fraction. The slack wax may be recovered as is, or may be subjected to additional processing, such as repulp filtration for removal of additional oil therefrom.

Solid-liquid separation techniques which may be employed for separation of wax crystals from the oil-solvent solutions include known solid-liquid separation processes, such as gravity settling, centrifugation, and filtration. Most commonly, in commercial processes, filtration in a rotary vacuum filter, followed by solvent wash of the wax cake, is employed.

Dewaxing solvents which may be used in solvent dewaxing processes include known dewaxing solvents. Commonly used solvents include aliphatic ketones of 3-6 carbon atoms, $C_2$-$C_4$ range hydrocarbons, $C_6$-$C_7$ aromatic hydrocarbons, halogenated $C_1$-$C_4$ hydrocarbons, and mixtures of such solvents. Solvent dilution of waxy oil stocks maintains fluidity of the oil for facilitating easy handling, for obtaining optimum wax-oil separation, and, for obtaining optimum dewaxed oil yields. The extent of solvent dilution depends upon the particular oil stocks and solvents used, the approach to filtration temperature in the cooling zone and the desired final ratio of solvent to oil in the separation zone.

For processes employing indirect cooling in scraped surface exchangers, cooling and wax crystallization are accomplished under conditions of very little agitation at a cooling rate in the range of about 1°-8° F/minute (0.56°-4.4° C/min). Under such conditions, without wall scrapers, wax tends to accumulate on the cold exchanger walls, interferring with heat transfer and causing increased pressure drop. Thus, scrapers are employed to remove the accumulated wax. Dewaxing solvents are employed to maintain fluidity of the oil in the coolers, and may be added before the oil is cooled or in increments during cooling. Often the oil is given a final dilution with solvent at the separation temperature for reducing solution viscosity such that wax separation is more efficient. Commonly, solvent added to the oil in such processes is at the same temperature, or somewhat higher temperature than the oil. Cold solvent, added at substantially lower temperatures than the oil, shock chills the oil resulting in formation of many small wax crystals which are difficult to separate. Under controlled conditions, elongated wax crystals of good size are formed which are easy to separate and which contain little occluded oil.

Dilution chilling processes employ incremental addition of cold solvent, e.g. +20° to −40° F (−6.7° to −40° C) to the oil under high degrees of agitation such that oil and solvent are completely mixed in less than one second. Under such conditions, wax precipitates in small, hard balls rather than elongated crystals. Such wax precipitates are easy to separate and retain very little oil.

Direct chilling processes employ a low boiling hydrocarbon, e.g. propylene, as dewaxing solvent and refrigerant. Waxy oil stock is diluted with sufficient low boiling hydrocarbon to provide the necessary cooling and provide the desired final dilution for separation of solid wax from the oil-solvent solution. The low boiling hydrocarbon is vaporized from the oil-low boiling hydrocarbon solution under conditions of reduced pressure, at a rate sufficient to cool the solution about 1°-8° F/minute (0.56°-4.4° C/min). Such cooling is continued until the desired separation temperature and amount of wax crystalization are obtained. At the separation temperature, sufficient low boiling hydrocarbon remains in solution with the oil to provide the desired fluidity for good separation of wax. Agitation of the mixture being cooled is commonly provided for reduction of temperature and concentration gradients.

In these processes of the prior art, rotating mechanical equipment, either wall scrapers or high speed agitators, are employed to facilitate good heat transfer from the oil and prevent accumulations of solid wax in heat exchangers. Such mechanical equipment is expensive, difficult to maintain, and can contribute to breaking and deformation of wax crystals.

SUMMARY OF THE INVENTION

Now, according to the present invention we have discovered improvements to continous solvent dewaxing processes for separating solid wax from waxy distillate petroleum oil stocks, wherein said waxy oil stock, heated, in a heating zone, to a temperature wherein all wax is dissolved in said oil stock, and treated with dewaxing solvent in a volume ratio of solvent to oil stock, in the range of about 1:1 to 5:1 respectively, wherein said mixture of oil and solvent is cooled, in a cooling zone, at a rate of about 1°-8° F minute (0.56°-4.4° C minute) to a selected separation temperature in the range of +25° to 40° F (3.9° to 40° C) for forming a mixture of wax crystals in oil-solvent solution, wherein said mixture is separated, in a solid-liquid separation zone, into a dewaxed oil-solvent solution and slack wax, and wherein said separated solution is fractionated, in a fractionation zone, to recover solvent and yield a dewaxed oil fraction; the improvement comprising:

(a) heating, in a heating zone, a continously flowing mixture of waxy oil stock and aromatic dewaxing solvent, having a volume ratio of aromatic solvent to oil of about 0.5/1 to about 2/1, to a temperature, in the range of about 80° F, (27° to 71° C) above the melting point of solid wax in said mixture for forming a solution of waxy oil stock and solvent;

(b) cooling, in a first cooling zone, said heated waxy oil stock/solvent, at a rate of about 1°-8° F/min (0.56° to 4.4° C/min) to a selected separation temperature in the range of about +25° F to 40° F (−4° to −40° C) for crystalizing wax and forming a wax/oil/solvent mixture;

(c) mixing, in a mixing zone, said wax/oil/solvent mixture, at said separation temperature, with ketone dewaxing solvent, at about said separation temperature, in a volume ratio of ketone solvent to waxy oil charge of about 0.5/1 to about 3/1, under conditions of plug flow radial mixing, for a period of about 15 seconds to about 2 minutes, for crystalizing additional wax from said waxy oil and forming a second wax/oil/solvent mixture; and (d) Flowing said second wax/oil/solvent mixture, at said separation temperature to said solid-liquid separation zone.

The advantages of the present invention over processes of the prior art include elimination of rotating mechanical equipment such as wall scrapers and/or agitators from the dewaxing process. Elimination of rotating mechanical equipment reduces cost of constructing solvent dewaxing facilities, and reduces manpower, expense and down time required for operating and maintaining such rotating mechanical equipment.

Plug flow radial mixing in the cooling zone results in improved heat transfer from the oil-solvent mixture in the cooling zone and reduces operating costs by improving efficiency. However, the greatest advantage is that transverse temperature differentials across the cross-sectional area of flowing oil-solvent mixture is reduced to about 1° F (0.56° C) or less, such that substantial sub-cooling of portions of the mixture close to the walls is avoided, thus reducing deposition of wax upon said cold walls. These advantages, and others will be explained more fully in the detailed description which follows.

BRIEF DESCRIPTION OF THE DRAWING

The drawing is a schematic representation of a solvent dewaxing process employing improvements of the present invent ion.

DESCRIPTION OF TERMS

Waxy petroleum distillate oil stocks are contemplated as charge stocks to the solvent dewaxing process of the present invention. Such waxy petroleum distillate oil stocks have a viscosity of less than 350 SUS at 100° F and have a boiling range of about 600°-650° F (315°-343° C) initial boiling point to about 1050°-1100° F (566°-593° C) end point. Such waxy petroleum distillate oil stocks may be derived from raw lube oil stocks the major portion of which boil above 650° F. (343° C). Such raw lube oil stocks can be vacuum distilled with overhead and side draw distillate streams and a bottom stream referred to as residual oil stock. Considerable overlap in boiling ranges of distillate streams and the residual stream may exist, depending upon distillation efficiency. Some heavier distillates have almost the same distribution of molecular species as the residual stream. Preferably, paraffinic crude oils are used as sources of lube oil stocks.

Such distillate streams contain aromatic and polar compounds which are undesirable in lubricating oils. Such compounds may be removed, by means such as solvent extraction, hydrogenation, and other means well known in the art, either before or after solvent dewaxing. Treatment of distillate streams for removal of aromatic and polar compounds before solvent dewaxing reduces the volume of oil to be dewaxed which concomitantly reduces the amount of solvent employed, heat load, etc.

The wax content of a waxy distillate oil stock is defined by the amount of material to be removed to produce a dewaxed oil with a selected pour point temperature in the range of about +25 to −40° F. (−3.9° to −40° C). Wax content of waxy distillate oil stock will vary in the range of 5 to 35 wt. percent. The wax material removed in solvent dewaxing is a complex mixture of straight chain and branched chain paraffins and naphthenic hydrocarbons. Wax in light distillate oil stocks generally predominantly comprises normal paraffin hydrocarbons which have relatively high crystal growth rates whereas wax in heavier oil stocks comprises substantial amounts of isoparaffin hydrocarbons which have slower crystal growth rates. In solvent dewaxing processes, wax is separated as solid crystals.

Dewaxed oil, as the term is used herein, is the product from the dewaxing process after solid wax and solvent have been removed.

Pour Point is the temperature at which an oil will cease to flow when chilled under prescribed conditions (ASTM-D-97-66). The pour point temperature of an oil stock is reduced in a solvent dewaxing process by removing wax therefrom. The pour point temperature of dewaxed oil determines the useful temperature range of lubricating oil manufactured therefrom, and is indicative of other properties such as viscosity, etc.

The Cloud Point is the temperature at which a cloud for haze of wax crystals first appears when a wax containing oil is cooled under prescribed conditions (ASTM-D-2500-66). The cloud point of a waxy oil stock may be depressed by addition of solvent in which oil and wax are soluble. The amount of cloud point depression is dependent upon degree of dilution with solvent, nature of feedstock, type or mixture of solvents employed, etc.

Dewaxing solvents which may be used in the process of the present invention will be selected from ketone dewaxing solvents and aromatic dewaxing solvents. Preferably ketone dewaxing solvent will be selected from ketones of 3 to 6 carbon atoms, particularly methyl ethyl ketone, and aromatic dewaxing solvent will be selected from aromatic hydrocarbons of 6-8 carbon atoms, particularly toluene.

Solvent dilution, within contemplation of the present invention, comprises diluting the waxy oil charge stock with aromatic solvent, in volume ratios in the range of about 0.5/1 to 2/1 solvent to oil, for improving wax removal from the oil, maintaining fluidity of the oil under cooling, or chilling, conditions in the process, obtaining optimum wax separation rates, and obtaining optimum dewaxed oil yields. The extent of aromatic solvent dilution is dependent upon the particular waxy oil stock, the solvent system employed, the extent of cooling in the cooling zone. Solvent dilution of waxy oil aromatic solvent mixture, with ketone solvent is contemplated to be at dilution ratios of ketone solvent to waxy oil charges in the 0.5/1 to 3/1 range for obtaining optimum wax separation from the oil and for providing the desired final ratio of wax/oil/solvent in the slurry going to the wax separation zone. In the prior art it is known that solvent may be added to waxy oil stock before cooling commences, (referred to as predilution), in increments as the oil stock is cooled, at the exit from the cooling zone, or by a combination of the above methods. One solvent may be added at one point in the solvent dewaxing process and another at another point, or the same solvent may be employed throughout.

Plug Flow Radial Mixing in the present invention refers to mixing the solvent-oil mixture in a tubular mixing zone by splitting the flowing fluid into two or more strata each of which is then helically rotated in one direction about its hydraulic center resulting in radially mixing the flowing fluid such that fluid is forced from the center of the tubular mixing zone outward to the outer wall of the tube, and vice versa, then splitting these strata into two or more additional strata, each of which is then helically rotated in the opposite direction about its hydraulic center, etc. The overall effect of such mixing is to cause the flowing stream to be continuously divided and redivided into strata which are continuously radially inverted, such that elements of the fluid entering at the center of the flowing stream are forced to the outer wall, and vice versa, on a continous basis. Such radial mixing is accomplished with very little backmixing such that the flow of fluid approximates plug flow. Flow of fluid may be in the laminer range or in the turbulent range. In such plug flow radial mixing, transverse gradients in temperature, and composition are substantially reduced or eliminated. Additionally, heat transfer from the body of flowing fluid to the wall of the mixer is substantially increased. Mechanical devices to accomplish such plug flow radial mixing may be obtained from Kenics Corporation, and are described in "MOTIONLESS MIXERS FOR VISCOUS POLYMERS", Chen and MacDonald, *Chemical Engineering,* Mar. 19, 1973, p. 105ff. In the present invention, plug flow radial mixing makes three important contributions to the process: Transverse temperature differences across the flowing fluid are reduced to 1° F (0.56° C) or less in the cooling zone such that super cooled oil-solvent mixture does not reside at the cold wall, depositing wax thereon; the flow of oil-solvent mixture is directed at the cold wall, scouring away any wax which may accumulate; and, in the mixing zone, solvent oil are rapidly blended into a mixture having a uniform temperature and composition throughout.

Cooling rate of waxy oil stock/solvent mixtures, in solvent dewaxing processes generally and the process of the present invention particularly, has been observed to be a major determinate of the size of wax crystals formed in the wax/oil/solvent mixture. Lower cooling rates yield larger, easy to separate crystals, with less oil occluded therein. Conventionally, oil-solvent mixtures are cooled at uniform slow rates in the range of 1°–8° F per minute (0.56° to 4/4/° C min). Preferably cooling rates are in the range of 1.5°-5° F per minute (0.83° to 2/78° C/min). Although larger wax crystals containing less occluded oil are formed at lower cooling rates, economy demands that the rate be at least about 1° F per minute (0.56° C/min). At cooling rates above about 8° F per minute (4.4° C/min), the wax crystals formed are small, difficult to separate and contain much occluded oil. Nucleation of new wax crystals and growth of existing wax crystals from an oil-solvent mixture are both proportional to the degree of supersaturation of wax in the oil-solvent mixture. As the oil-solvent mixture is cooled, wax crystallization, as new nuclei or as growth of existing crystals, lags as a result of mass transfer, such that the mixture is somewhat supersaturated. Nucleation of new wax crystals is favored over crystal growth at higher degrees of supersaturation which result from higher cooling rates. Thus, the lowest economical cooling rate is to be preferred. When waxy oil stock, or oil-solvent mixtures are cooled to the cloud point, a very large number of small wax crystal nuclei precipitate forming a haze or cloud in the mixture. Under conditions of uniform slow cooling, in the 1°–8° F per minute (0.56° to 4.4° C/min) range, these small crystals tend to grow into larger, easily separable crystals at the expense of formation of additional small wax crystal nuclei as the temperature is reduced.

DESCRIPTION OF THE DRAWING

For better understanding the process of the present invention reference is now made to the drawing. The drawing is a schematic representation of a solvent dewaxing process employing improvements of the present invention, and only those elements of the process necessary for an understanding of the present invention are included. Mechanical features and process equipment unnecessary for an understanding of the present invention have been omitted for the sake of clarity. The drawing, and the description which follows are intended to demonstrate one embodiment of the present invention, and are not to be construed as limitations of the invention which is set-out in the claims appended to this application.

In the drawing, waxy petroleum distillate oil stock (waxy oil stock) having physical properties within ranges heretofore set-out in the specification, flows continuosly, via line 1, into heating zone 2. Aromatic solvent, in an amount equivalent to 0.5–2 volumes of waxy oil stock flows continously, via line 3 into heating zone 2. In heating zone 2, waxy oil stock and aromatic solvent are heated by indirect heat exchange to a temperature at which all wax present is melted and a completely liquid solution results, e.g. 80°–160° F (26.7° to 71° C) for waxy oil stocks within contemplation of the present invention.

In the drawing, the oil/solvent solution having all wax dissolved therein, flows from heating zone 2, via line 4 into cooling zone 5. In cooling zone 5, the mixture is cooled at a uniform rate in the range of 1°–8° per minute (0.56° to 4.4° C/min), preferably 1.5°–5° F per minute (0.83° to 2.8° C/min), to a selected separation temperature in the range of 25° to − 40° F (−3.9° to −40° C). During this cooling step, wax crystalizes from the oil-solvent solution, thus decreasing the pour point of oil remaining in solution with the aromatic solvent. In cooling zone 5, as wax precipitates, a wax crystal/oil-/aromatic solvent mixture is formed.

In the drawing, the wax/oil/aromatic solvent mixture, at the selected separation temperature obtained in cooling zone 5 flows via line 6 to mixing zone 8. Ketone solvent, at, or up to about 5° F below, the selected separation temperature, flows via line 7 and nozzle 17 into mixing zone 17. The rate of ketone solvent injection is equivalent of about 0.5 to 3 times the volume rate of waxy oil charge to the process, and is selected to provide the desired crystallization of wax from waxy oil charge, and the desired fluidity of wax/oil/solvent mixture exiting mixing zone 8.

In mixing zone 8, ketone solvent from nozzle 17 is mixed intimately with the flowing stream of wax/oil-/aromatic solvent under conditions of plug flow radial mixing to form a solution of oil and solvent and to precipitate additional wax from the waxy oil stock. Ketone solvent is injected into the wax/oil/solvent stream flowing in mixing zone as a spray of fine droplets from nozzle 17. Many nozzles designed for dispersing liquids as a spray of fine droplets are commercially available and are suited for use in this service. The injected ketone solvent is thoroughly mixed with wax/oil/solvent mixture under conditions of plug flow radial mixing at about the selected separation temperature. At these conditions, additional wax is precipitated from the waxy oil stock and tend to accumulate upon wax crystals already formed. Plug flow radial mixing distributes the wax crystals homogeneously throughout the following mixture, thus improving mass transfer of wax from waxy oil stock to the wax crystlas. Mixing of wax/oil/solvent in mixing zone 8 continues for a period of about 15 seconds to 2 minutes for ensuring thorough mixing of ketone solvent with the wax/oil/solvent mixture and for ensuring equilibration of wax mass transfer from the waxy oil to the wax crystals.

In the drawing, wax-oil-solvent mixture, at the selected separation temperature obtained in mixing zone 8, flows via line 9 to solid-liquid- separation zone 10 wherein wax crystals are separated from oil-solvent solution. Solid-liquid separation may be accomplished by solid-liquid separation methods known in the art, such as gravity settling, centrifugal separation, filtration, etc. Preferably, and commonly practiced in commerical processes, wax is separated from oil-solvent solutions by vacuum filtration. That is, wax-oil solvent mixture at the separation temperature flows into a holding tank of a rotary vacuum filter having a rotating filter drum covered with a filter cloth. Oil-solvent solution is pulled through the filter cloth by an imposed vacuum, and wax accumulates upon the cloth as a filter cake. As the drum rotates out of the holding tank, additional oil-solvent solution entrained in the filter cake is pulled through the cloth, and commonly wash solvent is sprayed upon the filter cake to displace additional oil. Wash solvent, which may be the same or different from the dewaxing solvent, is likewise pulled through the filter cloth by vacuum action, carrying dissolved oil with it. After the solvent wash, air may be drawn through the wax filter cake for evaporating residual wash solvent, thereby drying the wax cake. At the end of the filter cycle, the wax cake is removed from the filter cloth by a blast of pressurized air, or a scraper such as a doctor knife, and the rotating drum carries the filter cloth into the holding tank for contact with additional wax-oil-solvent mixture.

In the drawing, wax from solid-liquid separation zone 10, known as slack wax and containing some oil entrained therein, is recovered via conduit 11 for further refining or for recovery as is. Separated oil-solvent solution, from solid-liquid separation zone 10, flows via line 12 to fractionation zone 13. In fractionation zone 13, the oil-solvent solution is separated into a ketone solvent fraction which is recovered via overhead line 14, an aromatic solvent fraction which is recovered via side-draw line 15, and a dewaxed oil fraction which is recovered as product via line 16.

In the process of the present invention, it is contemplated that waxy oil charge stock will be suitable for manufacture of lubricating oils. Thus, a particular waxy oil charge stock will have a boiling range, viscosity, and composition suitable for manufacturing a particular lubricating oil. Solvent dewaxing is preformed for removing wax from the waxy charge stock, thereby lowering the pour point temperature to a value suitable for the particular lubricating oil being manufactured. Other refining processes, outside the scope of the present invention, such as solvent extraction, hydrogenation, etc. are commonly performed on the waxy oil charge stock and/or the dewaxed oil for adjusting other properties of the oil, such as viscosity index, to values suitable for the particular lubricating oil.

Production of lubricating oils is a relatively low volume operation, compared to other petroleum refining operation. Consequently in commercial solvent dewaxing operations it is common practice to process one waxy oil stock at one time and other waxy oil stocks at other times, in blocked out operation.

Heating waxy oil stock and aromatic solvent in heating zone 2 is preferably by indirect heat exchange from a heating medium such as steam, hot gas, or other heat transfer fluid to the oil/aromatic solvent mixture. Heating zone 2 may conveniently be a heat exchanger such as a shell and tube exchanger, a double pipe exchanger, etc., or heating zone 2 may comprise heating coils suspended in a waxy oil stock storage tank. Heat is transferred from the heating fluid to the waxy oil stock primarily by convection. Maximum temperatures necessary for dissolving all the wax in the waxy oil stocks contemplated for processing according to the present invention do not exceed about 160° F (71° C) and commonly do not exceed about 130° F (54.4° C). Consequently, heat exchangers having high radiant heat flux, and hot tube walls, such as direct fired heaters, are not preferred for this service.

In mixing zone 8, ketone solvent from nozzle 17 is mixed with wax/oil/aromatic solvent in a step comprising injection of the ketone solvent followed by plug flow radial mixing to thoroughly mix the wax/oil-/aromatic solvent mixture and the ketone solvent. Preferably the ketone solvent is injected into the wax/oil-/aromatic solvent mixture via nozzle 17 as a fine spray of droplets. Such injection improves mixing. Plug flow radial mixing following the ketone solvent injection provides thorough mixing of wax, oil and solvents without use of rotating mixing equipment. Consequently construction, operating and maintenance expenses are substantially reduced over conventional dewaxing processes. Plug flow radial mixing, as previously described, comprises a series of steps wherein the flowing stream to be mixed is divided into strata, and each strata is rotated about its hydraulic center, forcing liquid from the center of the flowing streams to the outer walls, and liquid from the outer walls to the center. The next succeeding mixing step redivides the strata from the first step into new divisions, each comprising portions of all the strata from the first step, and rotates the new divisions in the opposite direction about their hydraulic center. Thus in each mixing step, each strata of the liquid (in this case wax, oil and solvent) is mixed, and in the next succeeding step, portions of each strata are mixed with each other. In order to obtain the degree of mixing desired for wax, oil and solvent in the present process, upon injection of the ketone solvent, from about 100,000 to about 1,000,000 divisions and redivisions (strata) of the wax, oil and solvent are required. This degree of mixing requires from about 9 to about 20 mixing elements in the plug flow radial mixer following each point of oil injection. The number of mixing elements will be determined by the degree of mixing and the type of mixer selected. Some commercially available plug flow radial mixers divide the flow into two strata at each step, and some mixers divide the flow into four strata at each step.

In plug flow radial mixing, a discreet amount of mixing is accomplished by each element at each step. In the present invention, relatively rapid mixture of ketone solvent into the wax/oil/aromatic solvent mixture following the injection point in mixing zone 8, is desirable. As each element of the plug flow radial mixers occupies a length of equivalent about 1.5 diameters of the tubular mixing zone, and as mixing zones for commercial scale solvent dewaxing units may conveniently be about six inches (15.24 cm) in diameter, a minimum velocity of about 0.5 ft/sec (0.3 m/sec) for solvent and oil in the mixing zone is desirable. Stated in a more generalized way, the preferred minimum velocity of solvent and oil in the mixing zone is equivalent to about two mixing zone diameters per second. A maximum to the flow velocity of waxy oil and solvent in the mixing zone is also desirable. This maximum is preferably equivalent to about eight mixing zone diameters per second (about 4 ft/sec. (1.22 m/sec) for a 6 inch (15.24 cm) diameters). Upon injection of ketone solvent into the wax/oil/solvent mixture, small regions of concentration discontinues develop, which are equilibrated as the way oil and solvent are thoroughly mixed. As the wax, oil and solvent are mixed and the concentrations equilibrate, additional wax will precipitate from the oil, and accumulate upon wax crystals already present. This crystallization of wax, that is equilibrating of wax concentration, takes a little time, and it is desirably completed before flowing the wax/oil/solvent mixture to the solid-liquid separation zone. A residence time in mixing zone 8 within the range of about 15 seconds to about 2 minutes will give sufficient time for the wax crystallization to equilibrate with shorter residence times within the range being suitable for lower viscosity wax/oil/solvent mixtures and with longer residence times required as such viscosity increases.

Cooling in cooling zone 5 is preferably via indirect heat exchange with a refrigerant fluid, preferably in double pipe heat exchangers under turbulent flow conditions. Although other heat exchanger configurations may be used if desired. For the preferred embodiment, such double pipe heat exchangers may be equipped with scrapers for removing any deposited wax from the cold exchanger walls. Preferably, however, such rotating mechanical equipment is replaced with stationary plug flow radial mixers. Plug flow radial mixing of the wax-oil-solvent mixture in cooling zone 5 reduces transverse temperature differentials across the flowing mixture to about 1° F or less, such that super cooling of the mixture at the cold wall, and concomitant precipitation of low melting point wax, in a cold zone near the cold wall produces two undesirable effects. The low melting point wax, when exposed to warmer oil-solvent mixtures becomes tacky or sticky. This sticky wax then tends to stick to the cold wall of the exchanger, contributing to wax build-up, decreased heat exchange rates, increased pressure drops, etc. Also, the sticky wax tends to agglomerate into irregular shaped larger particles ontaining substantial amounts of occluded oil, thereby contributing to decreased dewaxed oil product yields. As stated above, plug flow radial mixing of the wax/oil-/aromatic solvent mixture in the cooling zone eliminates stagnant cold liquid at the walls of the heat exchanger, thus the low melting point wax is not precipitated until the entire body of flowing is cooled to the crystallization temperature. Consequently the wax crystals formed do not tend to accumulate on the heat exchanger wall. Also, in plug flow radial mixing, the flowing mixture is directed at the heat exchanger wall, thus scouring away any wax which may accumulate thereon. Additionally, with plug flow radial mixing in cooling zone 5, wax tends to crystalize evenly throughout the flowing wax-oil-solvent mixture such that mass transfer of crystalizing wax from oil-solvent solution to an existing wax crystal is improved. Such improved mass transfer increases the growth rate of wax crystals and decreases the rate of wax crystal nuclei formation in the cooling zone.

EXAMPLE

In order to demonstrate the process of the present invention, the following example is provided. A solvent neutral oil of SAE-5 grade, derived from Arabian Light crude, is dewaxed according to the process of the present invention. Physical properties of the SAE-5 grade oil are given in Table I, below:

TABLE I

| SAE-5 Grade Oil | |
|---|---|
| Refractive Index/70° C | 1.4532 |
| Density/70° C (g/ml) | 0.8198 |
| Density/151° C (g/ml) | 0.8577 |
| Pour Point ° C | +29 |
| Vis/100° F C.P. | 16.73 |
| Vis/210° F C.P. | 3.66 |
| Viscosity Index | 114 |

In the example process, SAE-5 grade oil, mixed with 1.5 volumes toluene, is heated to a temperature of about 86° F (30° C) for melting all wax present therein. A continous stream of heated oil toluene mixture flows through a cooling zone comprising a double pipe exchanger having Kenics (TM) static mixers therein, wherein the mixture is cooled at 1° C/min (1.8° F/min to a temperature of −25° C (13° F). In the cooling zone wax precipitats forming a wax/oil/aromatic solvent mixture. From the cooling zone, the wax/oil/aromatic solvent mixture, at − 25° C, flows into a mixing zone, and methyl ethyl ketone solvent (MEK) is flowed, at at a rate equivalent to 1.75 times the flow rate of SAE-5 grade oil charge, into the mixing zone comprises a pipe having an inlet and an outlet, and having a nozzle for injection of MEK. The mixing zone is equipped Kenics (TM) static mixers of 20 elements following the injection nozzle. The nozzle comprises a restriction orifice which distributes the injected MEK as fine droplets into the flowing wax/oil/aromatic solvent stream.

In the mixing zone, a mixture of wax/oil/solvent is formed and maintained for about 1 minute to allow equilibration of wax crystallization at the −25° C (13° L F) separation temperature.

From the mixing zone, the wax-oil-solvent mixture is transferred at a temperature of 25° C (13° F) to a vacuum filter operating at 400 mm Hg pressure wherein wax is filtered from the oil-solvent mixture. Upon filtration, the wax filter cake is washed with an amount of solvent equivalent to 2.65 volumes of SAE-5 grade oil charge, and the solvent washed wax cake is air dried for 60 seconds. Dewaxed oil is recovered from the wax-free oil/solvent filtrate by fractional distillation.

Results of this experiment are shown in Table II below:

TABLE II

| | |
|---|---|
| Dewaxed Oil Yield (wt.% SAE-5 charge) | 76.3 |
| Dewaxed Oil Pour Point (° C) | −21 |
| Wax Yield (wt.% SAE-5 charge) | 19.3 |
| Wax Cake Oil Content (wt.% SAE-5 charge) | 1.45 |
| Filter Capacity (kg oil/m²/hr) | 161 |

Dewaxed oil, having a pour point of −21° C, is recovered in an amount equal to 76.3 weight percent of the SAE-5 grade oil charge to the process. Slack wax is recovered having an occluded content in an amount equivalent to 1.45 wt.% of the SAE-5 grade oil charge.

Thus, by following the method of the present invention, dewaxed oil of low pour point suitable for use in manufacturing lubricating oils may be produced in good yields. Additionally, slack wax having relatively low amounts of oil entrained therein is also recovered.

We claim:

1. In a continuous solvent dewaxing process for separating solid wax from waxy petroleum distillate oil stock, wherein said waxy oil stock, heated for dissolving all wax therein, is treated with dewaxing solvent in a volume ratio of solvent to oil of about 1:1 to 5:1, wherein the oil/solvent mixture is cooled at a rate of about 1°–8° F/min. to a selected separation temperature in the range of about +25° to −40° F for forming a mixture of wax crystals in oil-solvent solution, wherein said wax/oil/solvent mixture is separated, in a solid-liquid separation zone, into a dewaxed oil-solvent solution and slack wax, and wherein said dewaxed oil-solvent solution is fractionated, in a fractionation zone, to recover solvent and yield a dewaxed oil fraction; the improvement which comprises:

(a) heating, in a heating zone, a continuously flowing mixture of waxy oil stock and aromatic hydrocarbon dewaxing solvent, having a volume ratio of aromatic solvent to waxy oil of about 0.5/1 to 2/1, to a temperature above the melting point of solid wax for forming a waxy oil/aromatic solvent solution;

(b) cooling, in a cooling zone, said heated waxy oil-/aromatic solvent solution, at a rate of about 1°–8° F/min. to a selected separation temperature for crystallizing wax and forming a wax/oil/aromatic solvent mixture;

(c) mixing, in a mixing zone, said wax/oil/aromatic solvent mixture, at said separation temperature, with ketone dewaxing solvent, at about 0°–5° F below said separation temperature, in a volume ratio of ketone solvent to waxy oil charge in the range of 0.5/1 to 3/1, under conditions of plug flow radial mixing for a residence time sufficient for equilibrating wax crystallization and forming a second wax/oil/solvent mixture; and (d) flowing said second wax/oil/solvent mixture, at said separation temperature, to said solid-liquid separation.

2. The process of claim 1 wherein said aromatic solvent is toluene, and wherein said waxy oil/aromatic solvent mixture is heated to a temperature in the range of about 80°–160° F for melting said solid wax.

3. The process of claim 2 wherein said waxy oil-/aromatic solvent is cooled, in said cooling zone at a rate of about 1.5–5° F/min, via indirect heat exchange, under conditions of plug flow radial mixing.

4. The process of claim 3 wherein said ketone solvent and said wax/oil/aromatic solvent mixture are held in said mixing zone for a residence time in the range of 15 seconds to 2 minutes.

5. The process of claim 4 wherein said ketone solvent is methyl ethyl ketone.

* * * * *